US009199235B2

(12) United States Patent
Oshika et al.

(10) Patent No.: US 9,199,235 B2
(45) Date of Patent: Dec. 1, 2015

(54) TEST CHIP

(71) Applicants: Yumiko Oshika, Nagoya (JP); Chisato Yoshimura, Nagoya (JP); Chie Nakashima, Nagoya (JP)

(72) Inventors: Yumiko Oshika, Nagoya (JP); Chisato Yoshimura, Nagoya (JP); Chie Nakashima, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/224,521

(22) Filed: Mar. 25, 2014

(65) Prior Publication Data

US 2014/0234184 A1 Aug. 21, 2014

Related U.S. Application Data

(63) Continuation-in-part of application No. PCT/JP2012/066504, filed on Jun. 28, 2012.

(30) Foreign Application Priority Data

Sep. 30, 2011 (JP) ..... 2011-218510

(51) Int. Cl.
*G01N 15/06* (2006.01)
*G01N 33/00* (2006.01)
(Continued)

(52) U.S. Cl.
CPC ..... *B01L 3/502753* (2013.01); *B01L 3/50273* (2013.01); *B01L 2200/0605* (2013.01); *B01L 2200/0621* (2013.01); *B01L 2300/0816* (2013.01); *B01L 2300/0861* (2013.01);
(Continued)

(58) Field of Classification Search
USPC ..... 422/50, 68.1, 502, 503, 504; 436/43, 436/180
See application file for complete search history.

(56) References Cited

U.S. PATENT DOCUMENTS 4,892,708 A 1/1990 Wogoman
5,089,417 A 2/1992 Wogoman
(Continued)

FOREIGN PATENT DOCUMENTS

EP 2239584 A1 10/2010
JP A-64-25058 1/1989
(Continued)

OTHER PUBLICATIONS

International Search Report issued in International Patent Application No. PCT/JP2012/066504 dated Sep. 25, 2012.
(Continued)

*Primary Examiner* — Brian J Sines
(74) *Attorney, Agent, or Firm* — Oliff PLC

(57) ABSTRACT

A test chip includes a substrate, a lid member, a separation portion, a first flow path, and a first holding portion. The substrate includes a surface on which a flow path is formed. The lid member covers the surface of the substrate. By centrifugal force, the separation portion separates components of a test object liquid into a separated component and a residual component having a larger specific gravity than a specific gravity of the separated component. The first flow path guides the separated component from the separation portion to a receiving portion. The first holding portion holds at least part of the residual component overflowing from the separation portion in a case where the separated component separated in the separation portion is moved from the separation portion to the receiving portion. The first holding portion is connected to at least one of the separation portion and the first flow path.

13 Claims, 17 Drawing Sheets

(51) Int. Cl.
*G01N 33/48* (2006.01)
*B01L 3/00* (2006.01)

(52) U.S. Cl.
CPC .. *B01L2300/0864* (2013.01); *B01L 2400/0409* (2013.01); *B01L 2400/0688* (2013.01)

(56) References Cited

U.S. PATENT DOCUMENTS

| | | | |
|---|---|---|---|
| 2009/0142232 | A1 | 6/2009 | Okada et al. |
| 2009/0253130 | A1 | 10/2009 | Yoo |
| 2009/0298092 | A1 | 12/2009 | Tsai et al. |
| 2010/0052557 | A1 | 3/2010 | Van Der Veen et al. |
| 2010/0081213 | A1 | 4/2010 | Lee et al. |
| 2010/0255483 | A1 | 10/2010 | Ishii et al. |
| 2011/0053202 | A1 | 3/2011 | Parng et al. |
| 2012/0052557 | A1 | 3/2012 | Okada et al. |

FOREIGN PATENT DOCUMENTS

| | | |
|---|---|---|
| JP | A-2009-139369 | 6/2009 |
| JP | A-2010-66195 | 3/2010 |
| JP | A-2011-174952 | 9/2011 |
| WO | WO 2009/066737 A1 | 5/2009 |

OTHER PUBLICATIONS

Office Action issued in Japanese Patent Application No. 2011-218510 dated Jan. 14, 2014 (with translation).

International Preliminary Report on Patentability issued in International Patent Application No. PCT/JP2012/066504 dated Apr. 1, 2014.

Ducree, Jens, et al., "The centrifugal microfluidic Bio-Disk platform," J. Micromech. Microeng. 17 (2007), S103-S115.

May 18, 2015 Extended European Search Report issued in European Patent Application No. 12834966.9.

TEST CHIP

CROSS-REFERENCE TO RELATED APPLICATION

This application is a continuation-in-part of International Application No. PCT/JP2012/066504, filed Jun. 28, 2012, which claims priority from Japanese Patent Application No. 2011-218510, filed on Sep. 30, 2011. This disclosure of the foregoing application is hereby incorporated by reference in its entirety.

BACKGROUND

The present disclosure relates to a test chip and more specifically to a test chip for performing a chemical, medical or biological test, for example, by separating a liquid containing components having different specific gravities from each other.

In related art, in the field of chemical, medical and biological testing, a test chip, such as a microchip, has been proposed, the test chip being used in a case in which biological materials and chemical materials, such as DNA (Deoxyribo Nucleic Acid), enzymes, antigens, antibodies, proteins, viruses and cells, are detected and quantitated. In the conventional test chip, a test object liquid is injected into an internal liquid supply path, and the test chip is revolved while being retained horizontally. Then, a test chip, which conducts a test by moving the liquid to a plurality of mixing tanks inside a flow path formed inside the test chip while using centrifugal force generated by the revolution, has a structure in which the centrifugal force is applied to blood to separate blood plasma and blood cells in a separation portion and to take out part of the blood plasma.

SUMMARY

The conventional test chip has a problem in which a residual component remained in the separation portion, such as a blood cell residue, flows out to a next stage, when centrifugal force is applied in the same direction as the direction in which blood plasma is taken out after being separated. In this case, the residual component is mixed into the blood plasma, so that the accuracy of testing may be lowered.

The present disclosure has been made to solve the above-described problems, and an object thereof is to provide a test chip capable of preventing a residual component separated in a separation portion from flowing out to a next stage.

Embodiments provide a test chip that includes a substrate, a lid member, a separation portion, a first flow path, and a first holding portion. The substrate includes a surface on which a flow path is formed. The lid member is configured to cover the surface of the substrate. The separation portion is configured to separate components of a test object liquid into a separated component and a residual component by centrifugal force. The residual component has a larger specific gravity than a specific gravity of the separated component. The first flow path is configured to guide the separated component from the separation portion to a receiving portion. The receiving portion is connected to the separation portion. The first holding portion is configured to hold at least part of the residual component, the part of residual component overflowing from the separation portion in a case where the separated component separated in the separation portion is moved from the separation portion to the receiving portion via the first flow path. The first holding portion is connected to at least one of the separation portion and the first flow path.

Embodiments also provide a test chip that includes a substrate and a cover portion. The substrate includes a surface on which a flow path is formed. The cover portion is configured to cover the surface of the substrate. The test chip also includes a separation portion, a receiving portion, and a first holding portion. The separation portion is for centrifugally separating components of a liquid into a separated component and a residual component. The liquid is injected into the test chip. The residual component has a larger specific gravity than a specific gravity of the separated component. The receiving portion is configured to receive, via a first flow path, the separated component centrifugally separated in the separation portion. The first flow path is connected to the separation portion. The first holding portion is configured to receive, via a second flow path, the residual component separated in the separation portion. The second flow path is connected to a wall on a side of an extending direction of the first flow path. The wall is one of walls that form the separation portion. The extending direction is a direction to which the first flow path extends from the separation portion.

Embodiments also provide a chip that includes a substrate and a cover portion. The substrate includes a surface on which a passage is formed. The cover portion is configured to cover the surface of the substrate. The chip also includes a first recessed portion, a chamber, a first passage, a second passage, and a third passage. The first recessed portion has an opening only in a first direction. The first direction is perpendicular to a second direction. The second direction is a direction from the cover portion to the substrate. The chamber is connected to the first recessed portion. The first passage extends from the first recessed portion in a third direction. The third direction intersects with the first direction and the second direction. The second passage connects the chamber and a wall on a side of the third direction. The wall is one of walls that form the first recessed portion. The third passage extends from the first recessed portion toward a side that is opposite to an extending direction of the first passage and connects to a second recessed portion. The extending direction is a direction to which the first passage extends from the first recessed portion. The second recessed portion is a recessed portion provided on the third passage.

BRIEF DESCRIPTION OF THE DRAWINGS

Embodiments will be described below in detail with reference to the accompanying drawings in which.

DETAILED DESCRIPTION OF EMBODIMENTS

A first embodiment of the present disclosure will be explained below. In the present embodiment, a test chip 1 is mounted on a test device 100 shown in FIG. 1 with a bottom surface of the test chip 1 being positioned in parallel with the direction of gravity, which is a back and forth direction of the paper. By revolving the test chip 1, the centrifugal force is applied to the test chip 1. In the test chip 1, a separated component and a residual component having different specific gravities from each other are centrifugally separated from a test object liquid by the centrifugal force. For example, in the test chip 1, when blood is the test object liquid, blood plasma and blood cells are centrifugally separated from the test object liquid, the blood plasma being the separated component and the blood cells being the residual component. In the test chip 1, when the separated component is moved to a test stage, which is a next stage after the separation stage, the residual component is inhibited from flowing into the next stage.

Figure 1:
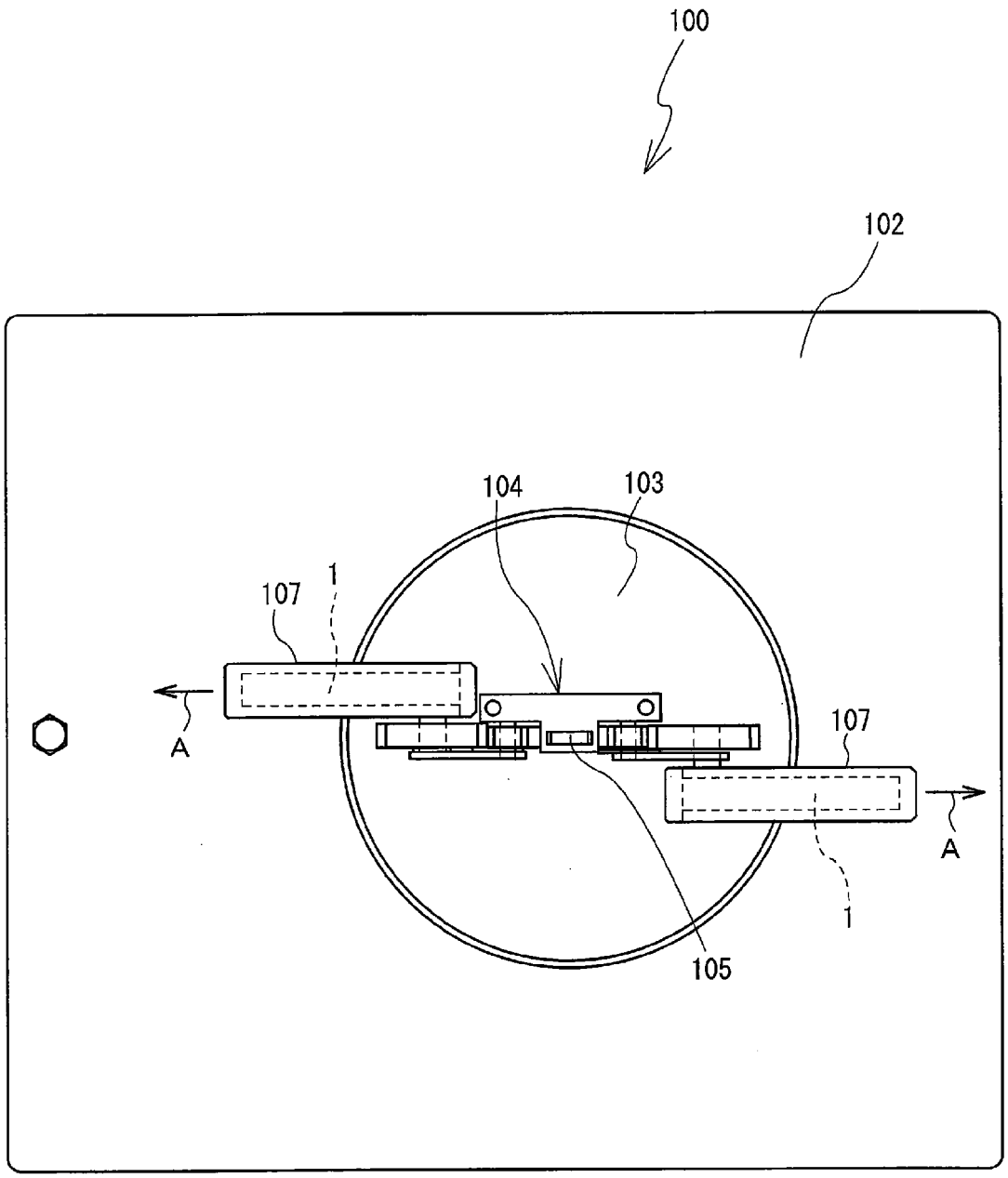
FIG. 1 is a plan view of a test device 100.

As shown in FIG. 1, a rotating disc-shaped turntable 103 is provided on an upper plate 102 of the test device 100. A holder angle changing mechanism 104 is provided on the turntable 103. In the holder angle changing mechanism 104, a pair of holders 107, which rotate by a predetermined angle, are provided. When the test chip 1 is inserted into the holder 107, the test chip 1 is fixed inside the holder 107. Below the upper plate 102, a motor, which is not shown in the figures, is provided to rotationally drive the turntable 103. As a result of the turntable 103 rotating centering around a central section 105 thereof as an axial center, centrifugal force is applied, in the direction of an arrow A, to each of the test chip 1 inserted into each of the holders 107. An operation of the holder angle changing mechanism 104 causes the holder 107 to be rotated and makes it possible to change the direction of the centrifugal force applied to the test chip 1.

Figure 2:
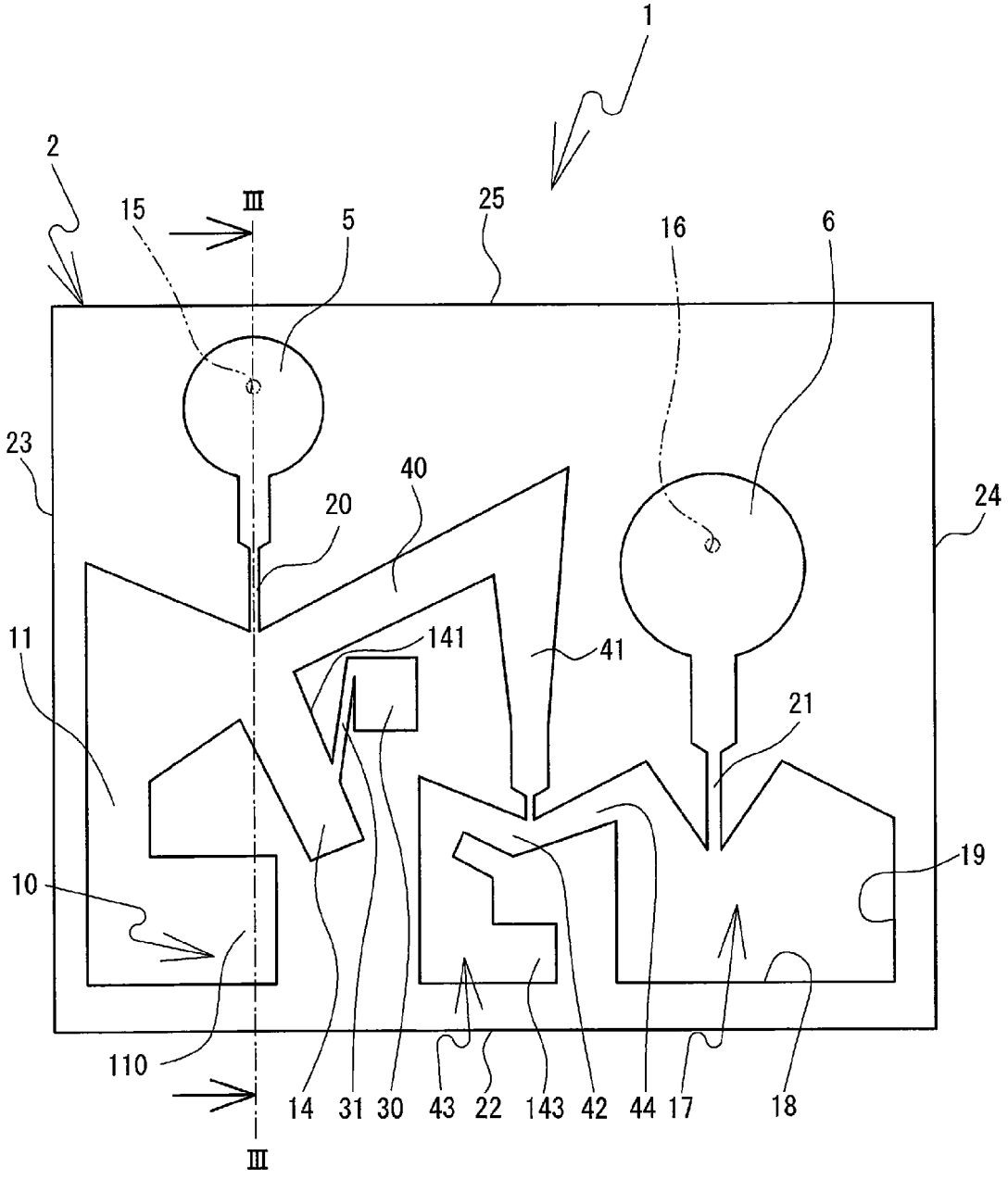
FIG. 2 is a front view of a plate member 2 in a state in which a cover member 3 of a test chip 1 is removed.
Figure 5:
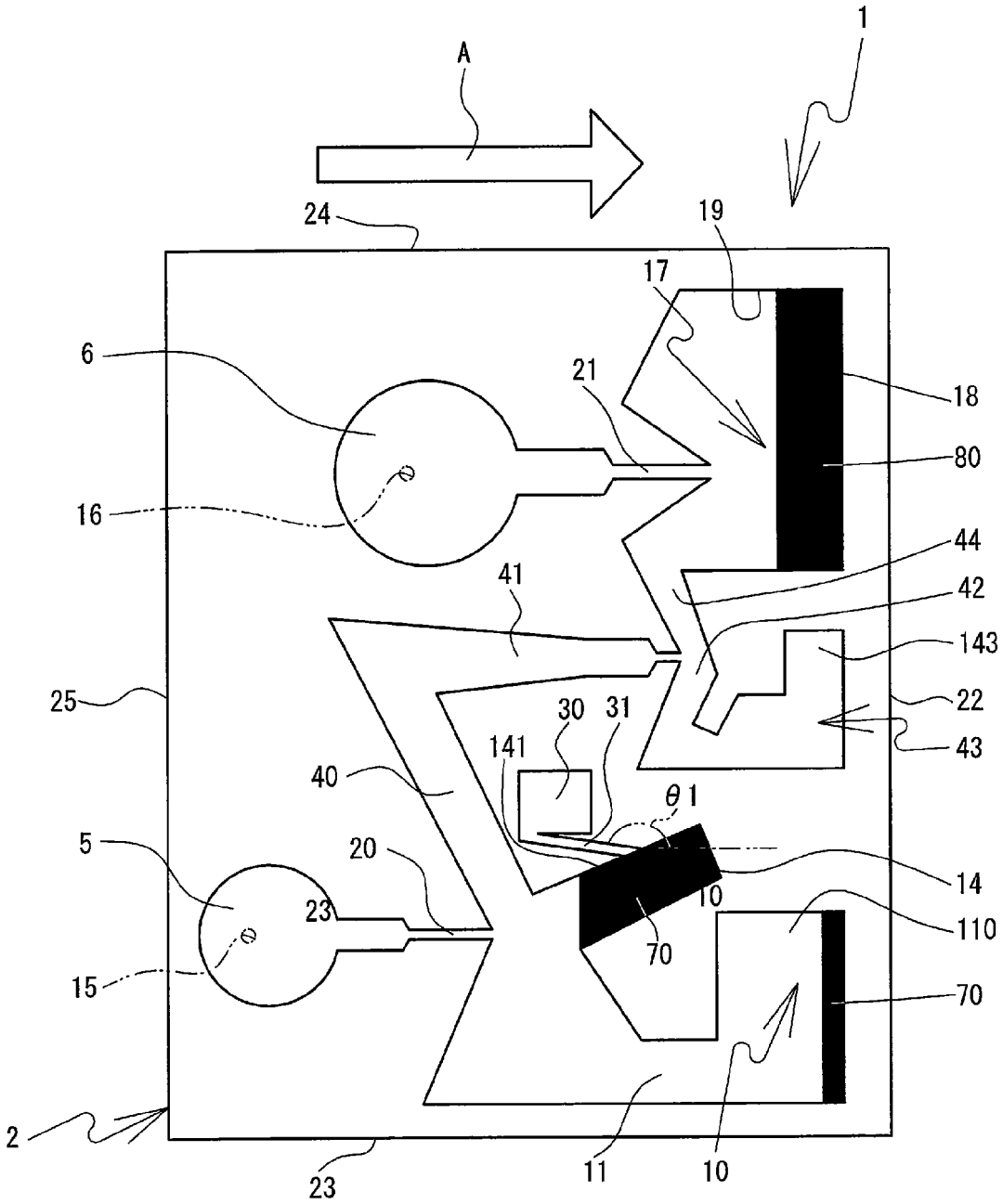
FIG. 5 is a front view of the plate member 2 in a state in which the test chip 1 is rotated by 90 degrees in the counter-clockwise direction from an initial angle and centrifugal force is applied thereto.

A state of the test chip 1 shown in FIG. 2 is defined as an initial state. In FIG. 2, the direction of gravity is a downward direction. For example, as shown in FIG. 5, when the test chip 1 is revolved in a state in which the test chip 1 is rotated by 90 degrees in the counterclockwise direction from the initial state, the centrifugal force larger than the gravitational force is applied to the test chip 1 in the direction of the arrow A shown in FIG. 5. The centrifugal force causes the test object liquid injected into the test chip 1 to move.

Figure 3:
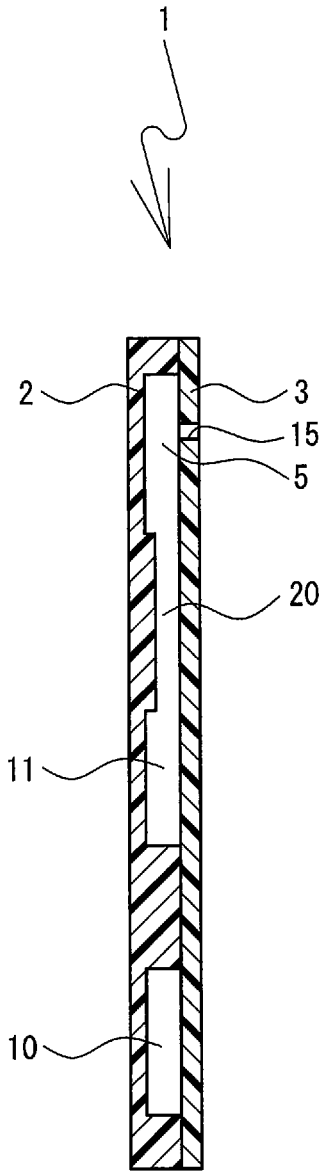
FIG. 3 is a cross-section diagram of the test chip 1 taken along a line X-X in FIG. 2.

As shown in FIG. 2 and FIG. 3, the test chip 1 is provided with a plate member 2 having a predetermined thickness. The plate member 2 is a plate-shaped member of a rectangular shape in a front view that is formed by a lower end portion 22, an upper end portion 25, a left end portion 23 and a right end portion 24. A synthetic resin can be used as a material of the plate member 2, for example.

The plate member 2 is provided with a first liquid accumulation portion 5, the separation portion 14, a guiding path 20, a sixth flow path 11, and a first excess portion 10. The first liquid accumulation portion 5, the separation portion 14, the guiding path 20, the sixth flow path 11, and the first excess portion 10 are formed by a recessed portion drilled down to a predetermined depth from a cover member 3 toward the plate member 2 shown in FIG. 3. The separation portion 14 receives a predetermined amount of liquid that has flowed out of the first liquid accumulation portion 5. The received liquid is centrifugally separated in the separation portion 14. The guiding path 20 leads a liquid from the first liquid accumulation portion 5 to the separation portion 14. In the separation portion 14, by the centrifugal force applied to the test chip 1, the liquid measured off by the predetermined amount is separated into the separated component having a small specific gravity and the residual component having a specific gravity larger than that of the separated component. A remaining liquid after the liquid is measured off in the separation portion 14, namely, an excess liquid that has overflowed from the separation portion 14, flows into the sixth flow path 11. The first excess portion 10 is provided on a downstream side of the sixth flow path 11. The excess liquid that flows through the sixth flow path 11 is accumulated in the first excess portion 10.

A first flow path 40, a fourth flow path 41, a measuring portion 42, and a second excess portion 43 that are formed by a recessed portion drilled down to a predetermined depth, and are provided in the plate member 2. A liquid of the separated component measured and separated in the separation portion 14 flows into the first flow path 40. The fourth flow path 41 is connected to a downstream side of the first flow path 40. The measuring portion 42 is provided on a downstream side of the fourth flow path 41, and a predetermined amount of the liquid of the separated component is measured off in the measuring portion 42. The second excess portion 43 accumulates the remaining liquid after the liquid is measured off in the measuring portion 42, namely, an excess liquid that has overflowed from the measuring portion 42. The plate member 2 is provided with a fifth flow path 44 and a receiving portion 17. A liquid that is measured off in the measuring portion 42 flows through the fifth flow path 44. The receiving portion 17 is provided on a downstream side of the fifth flow path 44. The liquid that is measured off in the measuring portion 42 flows into the receiving portion 17. A second liquid accumulation portion 6 and a guiding path 21 that are formed by a recessed portion drilled down to a predetermined depth, and are provided in the plate member 2. The second liquid accumulation portion 6 accumulates a test reagent, a liquid, etc. that is injected into the receiving portion 17. The guiding path 21 is a flow path through which a liquid flows from the second liquid accumulation portion 6 to the receiving portion 17.

A holding portion 30 is connected by a second flow path 31 to a side wall portion 141 of the separation portion 14 on a side of the first flow path 40, the holding portion 30 being formed by a recessed portion drilled down to a predetermined depth and being a trap for inhibiting the residual component separated in the separation portion 14 from flowing out into the first flow path 40.

The cover member 3, which covers a surface of the test chip 1, is attached to a front surface side of the test chip 1. The cover member 3 seals off the first liquid accumulation portion 5, the second liquid accumulation portion 6, the separation portion 14, the first excess portion 10, the measuring portion 42, the second excess portion 43, the receiving portion 17, the first flow path 40, the second flow path 31, the sixth flow path 11, the fourth flow path 41, the guiding path 20 and the guiding path 21, etc. The cover member 3 is formed by a thin transparent synthetic resin plate having the same rectangular shape in a front view as shape of the plate member 2. An injection inlet 15 for injecting the test object liquid, a test reagent, etc. into the first liquid accumulation portion 5 and an injection inlet 16 for injecting a test reagent, a liquid, etc. into the second liquid accumulation portion 6 are formed in the cover member 3.

The first liquid accumulation portion 5 is a portion in which the test object liquid, the test reagent or the like, which is injected from the injection inlet 15, is accumulated. The first liquid accumulation portion 5 is drilled in a circular shape in a front view down to a predetermined depth with respect to the plate member 2. The second liquid accumulation portion 6 is a portion in which the test object liquid, the test reagent or the like, which is injected from the injection inlet 16, is accumulated. The second liquid accumulation portion 6 is drilled in a circular shape in a front view down to a predetermined depth with respect to the plate member 2.

The separation portion 14 is provided below the first liquid accumulation portion 5 shown in FIG. 2. The separation portion 14 is a recessed portion that has a predetermined depth, a predetermined width and a predetermined length with respect to the plate member 2. The separation portion 14 is formed such that a bottom portion side of the separation portion 14 extends toward the lower end portion 22 (the lower side in FIG. 2). The bottom portion side of the separation portion 14 also extends while inclining toward the receiving portion 17 that is the next stage of the test chip 1, namely, the bottom portion side of the separation portion 14 gets closer to the receiving portion 17 with distance from the guiding path 20, as shown in FIG. 2.

The holding portion 30 is a recessed portion having a rectangular shape in a front view. One end portion of the second flow path 31 is connected to an upper portion of the holding portion 30, and the other end portion of the second flow path 31 is connected to the side wall portion 141 of the separation portion 14. When the separated component separated in the separation portion 14 is caused to flow into the first flow path 40 on a side of the next stage, the residual component is caused to flow into the holding portion 30 from the second flow path 31. Therefore, it is possible to inhibit the residual component from flowing into the first flow path 40.

The sixth flow path 11 is a recessed portion formed on the plate member 2, having a predetermined width, a predetermined depth and a predetermined length, and is formed toward the first excess portion 10. The first excess portion 10 is provided on the downstream side of the sixth flow path 11. A liquid that has flowed out of the first liquid accumulation portion 5 flows into the separation portion 14. A remaining liquid after the predetermined amount of liquid is measured off from the liquid in the separation portion 14 is accumulated in the first excess portion 10. The first excess portion 10 is a recessed portion having a predetermined depth, a predetermined width and a predetermined length. In a front view, the first excess portion 10 is a recessed portion of a rectangular shape that extends in parallel with the lower end portion 22 of the test chip 1. A rear portion 110 of the first excess portion 10 extends up to below the separation portion 14.

The first flow path 40 is a recessed portion having a predetermined depth, a predetermined width and a predetermined length. The first flow path 40 extends in a right upward direction from an opening portion of an upper portion of the separation portion 14 toward the second liquid accumulation portion 6. The fourth flow path 41, which is a recessed portion having a predetermined depth, a predetermined width and a predetermined length, extends from a downstream end portion of the first flow path 40 toward the lower end portion 22 of the test chip 1. On the downstream side of the fourth flow path 41, the measuring portion 42 is formed that measures off the predetermined amount of the separated component separated in the separation portion 14. The measuring portion 42 is a recessed portion that is formed in a V-shape in a front view and has a predetermined depth, a predetermined width and a predetermined length. The receiving portion 17 is formed on a downstream side of the measuring portion 42, which is on a side of the right end portion 24 shown in FIG. 2. The measuring portion 42 and the receiving portion 17 are connected by the fifth flow path 44.

The receiving portion 17 is a recessed portion drilled down to a predetermined depth with respect to the plate member 2. In the receiving portion 17, the separated component measured off in the measuring portion 42 is caused to flow into and mix with a test reagent, a liquid or the like that is caused to flow from the second liquid accumulation portion 6. On a left side of the measuring portion 42 shown in FIG. 2, the second excess portion 43 is formed into which flows an excess separated component that has overflowed from the measuring portion 42. The second excess portion 43 is a recessed portion drilled down to a predetermined depth, and a rear portion 143 of the second excess portion 43 extends toward the receiving portion 17.

One Example of a Usage Method of a Test Chip 1

Figure 4:
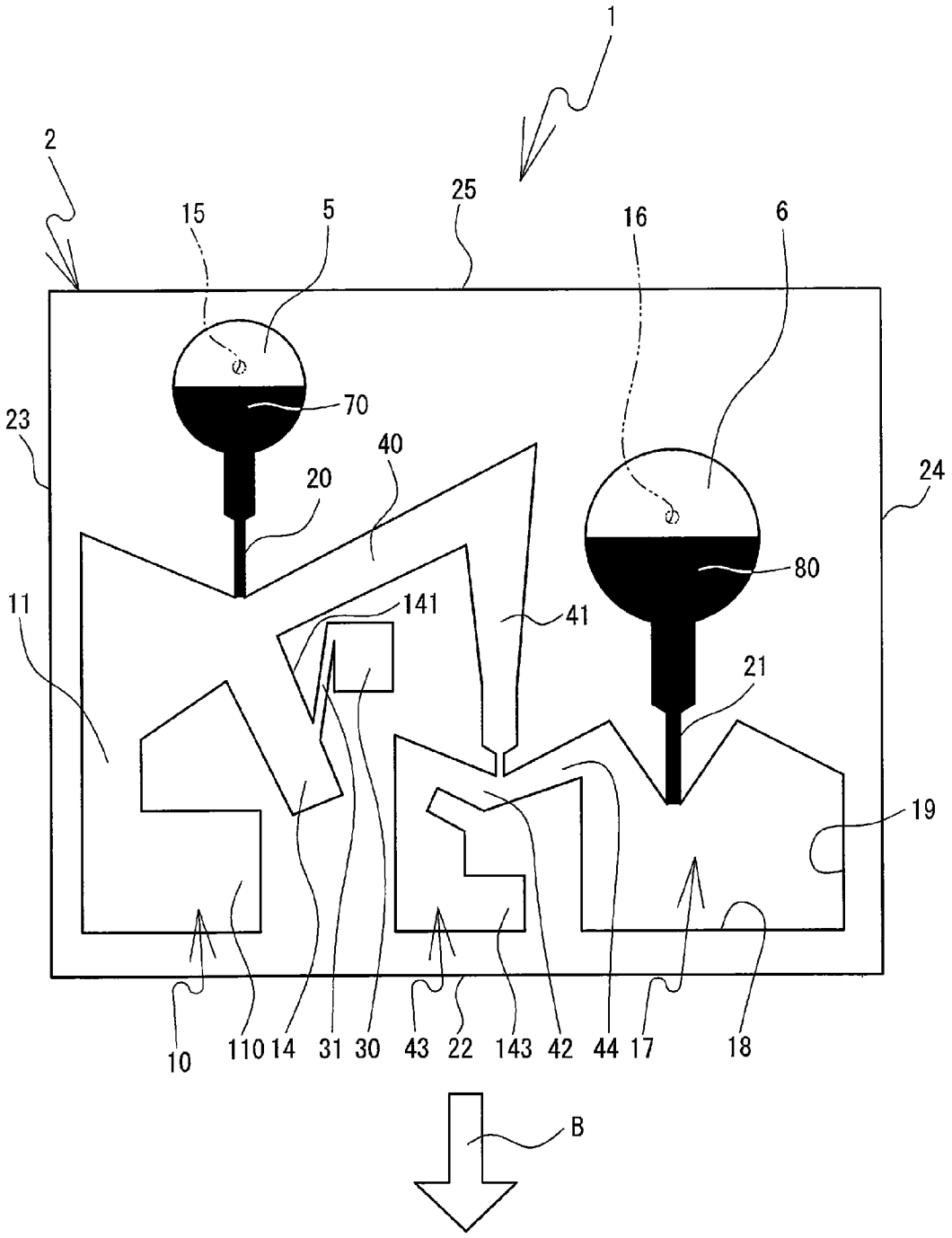
FIG. 4 is a front view of the plate member 2 in a state in which a test object liquid 70 and a test reagent 80 are injected into the test chip 1.

With respect to a usage method of the test chip 1, first, as shown in FIG. 4, the test object liquid is injected into the first liquid accumulation portion 5 from the injection inlet 15 and a test reagent is injected into the second liquid accumulation portion 6 from the injection inlet 16. Next, the test chip 1 is held by the holder 107 of the turntable 103 of the test device 100 shown in FIG. 1 in a state in which extending directions of the left end portion 23 and the right end portion 24 are parallel with the direction of gravity, which is the direction of an arrow B, and extending directions of the upper end portion 25 and the lower end portion 22 are perpendicular to the direction of gravity. Next, when the test chip 1 is rotated by 90 degrees in the counterclockwise direction from the state in which the test chip is held, a state shown in FIG. 5 is obtained, and the extending directions of the left end portion 23 and the right end portion 24 of the test chip 1 are positioned in parallel with the diameter direction of the turntable 103 of the test device 100 in FIG. 1.

In the state shown in FIG. 5, when the test chip 1 is revolved by the test device 100, the centrifugal force is applied in the direction of the arrow A in FIG. 5. The centrifugal force causes the test object liquid 70 accumulated in the first liquid accumulation portion 5 to flow out therefrom in the direction of the centrifugal force. The liquid 70 that has flowed out from the first liquid accumulation portion 5 flows into the separation portion 14, and an overflow amount thereof flows through the sixth flow path 11 and enters into the first excess portion 10. As shown in FIG. 5, the centrifugal force causes the overflow liquid 70 that enters into the first excess portion 10 to be drawn to a side of the lower end portion 22 of the test chip 1. An angle θ1 formed by an extension line and an extending direction of the second flow path 31 is greater than or equal to 90 degrees. The extension line extends in the direction of the centrifugal force, as indicated by the direction of the arrow A in FIG. 5, from a connection portion of the second flow path 31 and the side wall portion 141 of the separation portion 14. If the angle θ1 is greater than or equal to 90 degrees, when a liquid is caused to flow into the separation portion 14 from the first liquid accumulation portion 5, it is possible to inhibit the liquid from flowing into the second flow path 31. Note that the maximum value of the angle θ1 is equivalent to the maximum angle value that allows the second flow path 31 to be connected to the side wall portion 141.

Figure 6:
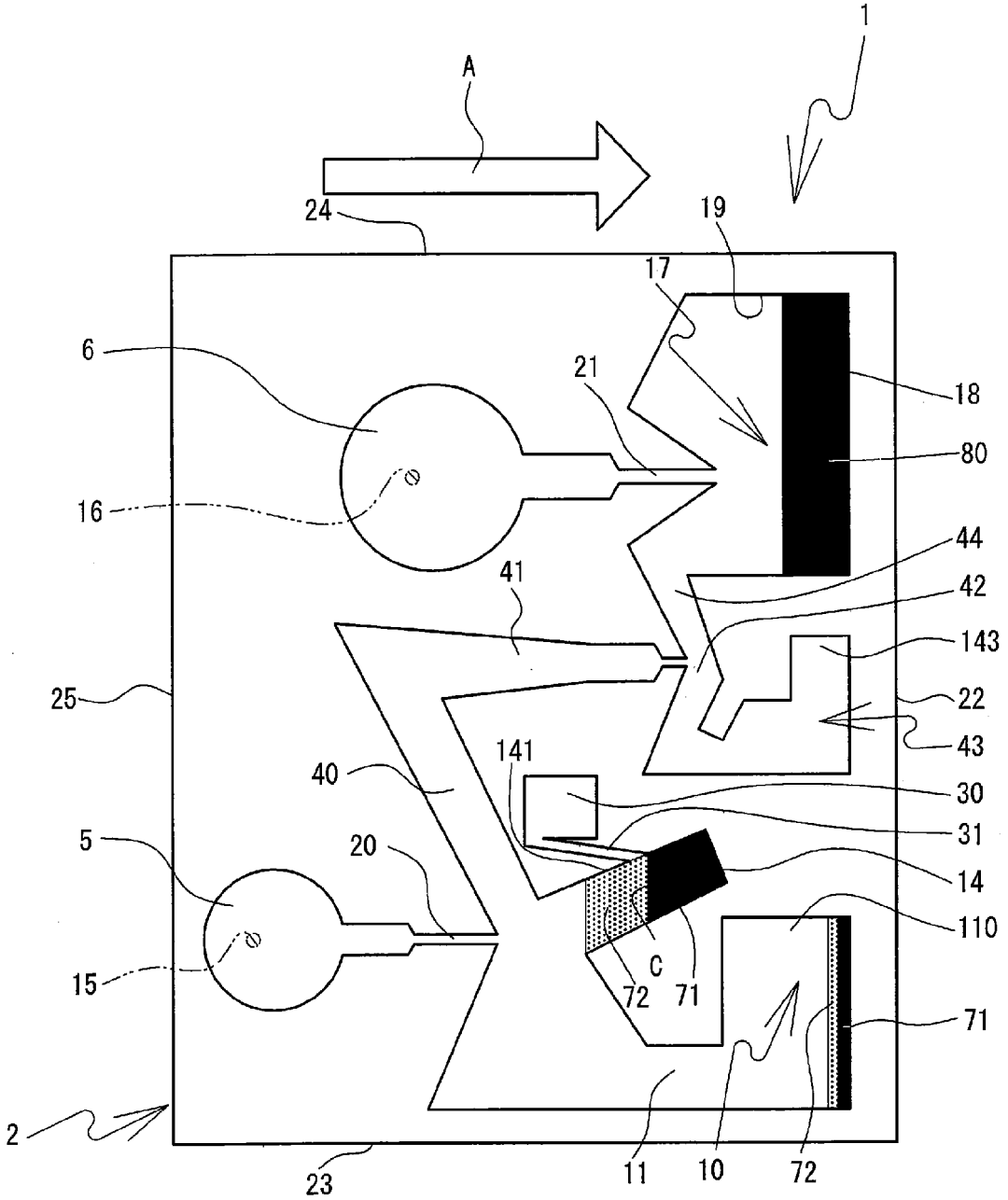
FIG. 6 is a front view of the plate member 2 showing a state in which the centrifugal force is further applied to the test chip 1 and centrifugal separation is performed in a separation portion 14.

A test reagent 80 that has accumulated in the second liquid accumulation portion 6 flows out in the direction of the centrifugal force and flows into the receiving portion 17. As shown in FIG. 5, as the centrifugal force is applied in the direction of the arrow A, the test reagent 80 inside the receiving portion 17 is drawn to a side of a bottom portion 18. In a case where the test object liquid 70 that has flowed into the separation portion 14 is a mixed liquid with components having different specific gravities from each other, the test object liquid 70 is centrifugally separated into a separated component 72 and a residual component 71 when the test device 100 continues to revolve the test chip 1 in the state shown in FIG. 5. The separated component 72 has a small specific gravity and the residual component 71 has a specific gravity larger than that of the separated component 72, as shown in FIG. 6. When blood is used as the liquid 70 as one example, it is separated into blood plasma, which is the separated component 72, and blood cells, which are the residual component 71. In terms of volume, the blood plasma and the blood cells have an approximately one to one relationship, for example. Therefore, as shown in FIG. 6, a boundary surface C between the separated component 72 and the residual component 71 is formed in a central portion of the separation portion 14. The connection portion of the side wall portion 141 of the separation portion 14 and the second flow path 31 is provided so as to be positioned on an upstream side in the direction of the centrifugal force with respect to the boundary surface C. In this case, as an inlet port of the second flow path 31 is positioned on a side of the separated component 72, it is possible to inhibit the second flow path 31 from being clogged with the residual component 71.

Figure 7:
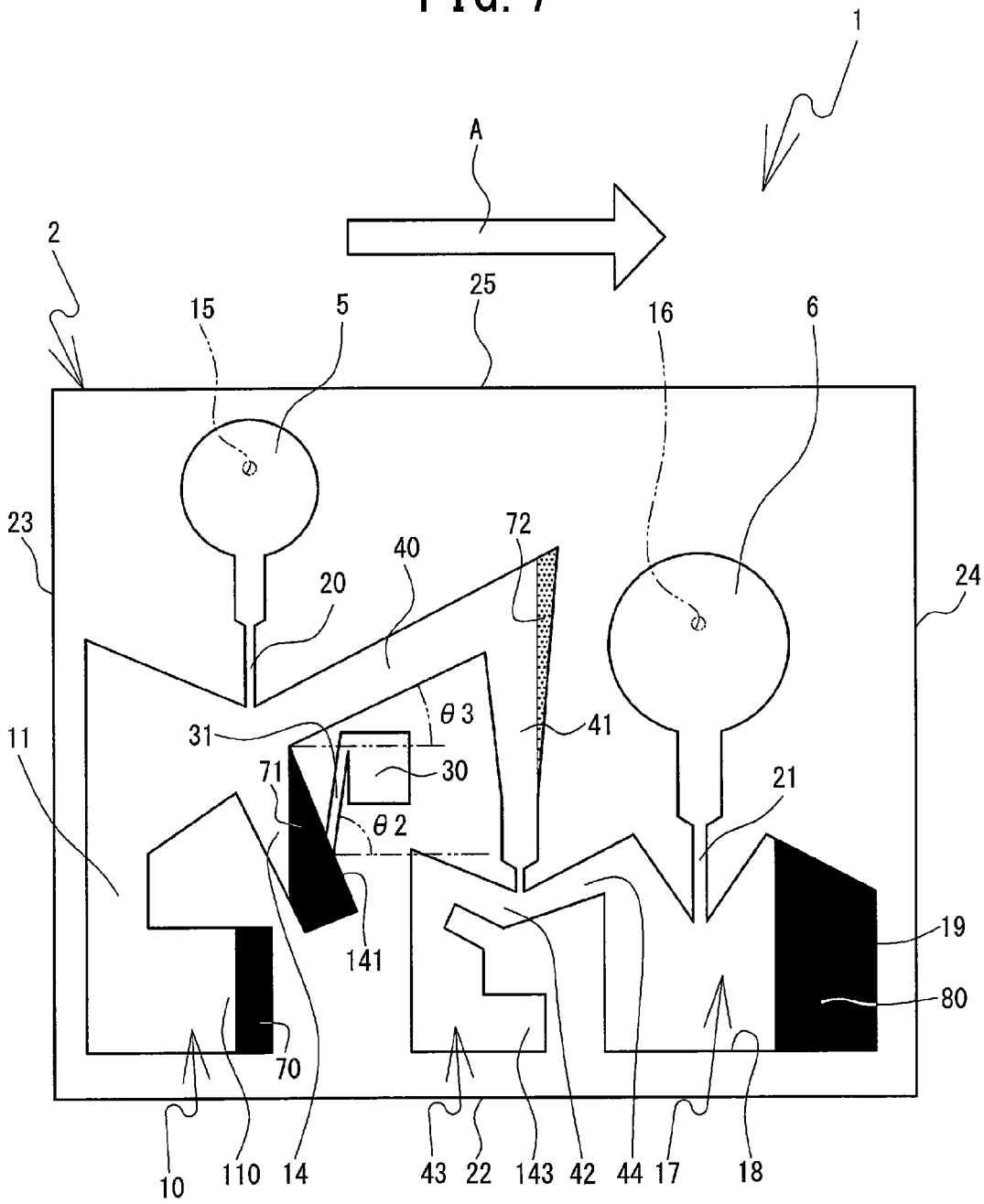
FIG. 7 is a front view of the plate member 2 showing a state in which the test chip 1 is rotated by 90 degrees in the clockwise direction from a state shown in FIG. 6, the centrifugal force is applied thereto, and a separated component 72 is moved to a next stage.

Next, when the test chip 1 is rotated by 90 degrees in the clockwise direction from a state shown in FIG. 6, the state becomes a state shown in FIG. 7, and extending directions of the lower end portion 22 and the upper end portion 25 of the test chip 1 are positioned in parallel with the diameter direction of the turntable 103 of the test device 100. In the state shown in FIG. 7, when the test chip 1 is revolved by the test device 100, the centrifugal force is applied in the direction of the arrow A shown in FIG. 7. As a result, due to the component force of the centrifugal force, the separated component 72 separated in the separation portion 14 climbs up the inclined side wall portion 141 of the separation portion 14 and flows through the first flow path 40, so that the separated component 72 is accumulated on a right side of the fourth flow path 41. The residual component 71 remains in the separation portion 14, as shown in FIG. 7. Note that the liquid 70 in the first excess portion 10 is accumulated on a side of the rear portion 110, and the test reagent 80 in the receiving portion 17 is accumulated on a side of a right wall 19 of the receiving portion 17. Here, as shown in FIG. 7, an angle θ2 is larger than an angle θ3. The angle θ2 is formed by the extending direction of the second flow path 31 and the direction of the centrifugal force as indicated by the direction of the arrow A, and is formed on the side of the receiving portion 17. The angle θ3 is formed by the direction of the centrifugal force and an extending direction of the first flow path 40, and is formed on the side of the receiving portion 17. As a result, when the centrifugal force is applied, the separated component easily flows into the first flow path 40, and it is possible to inhibit the separated component from flowing into the second flow path 31.

Figure 8:
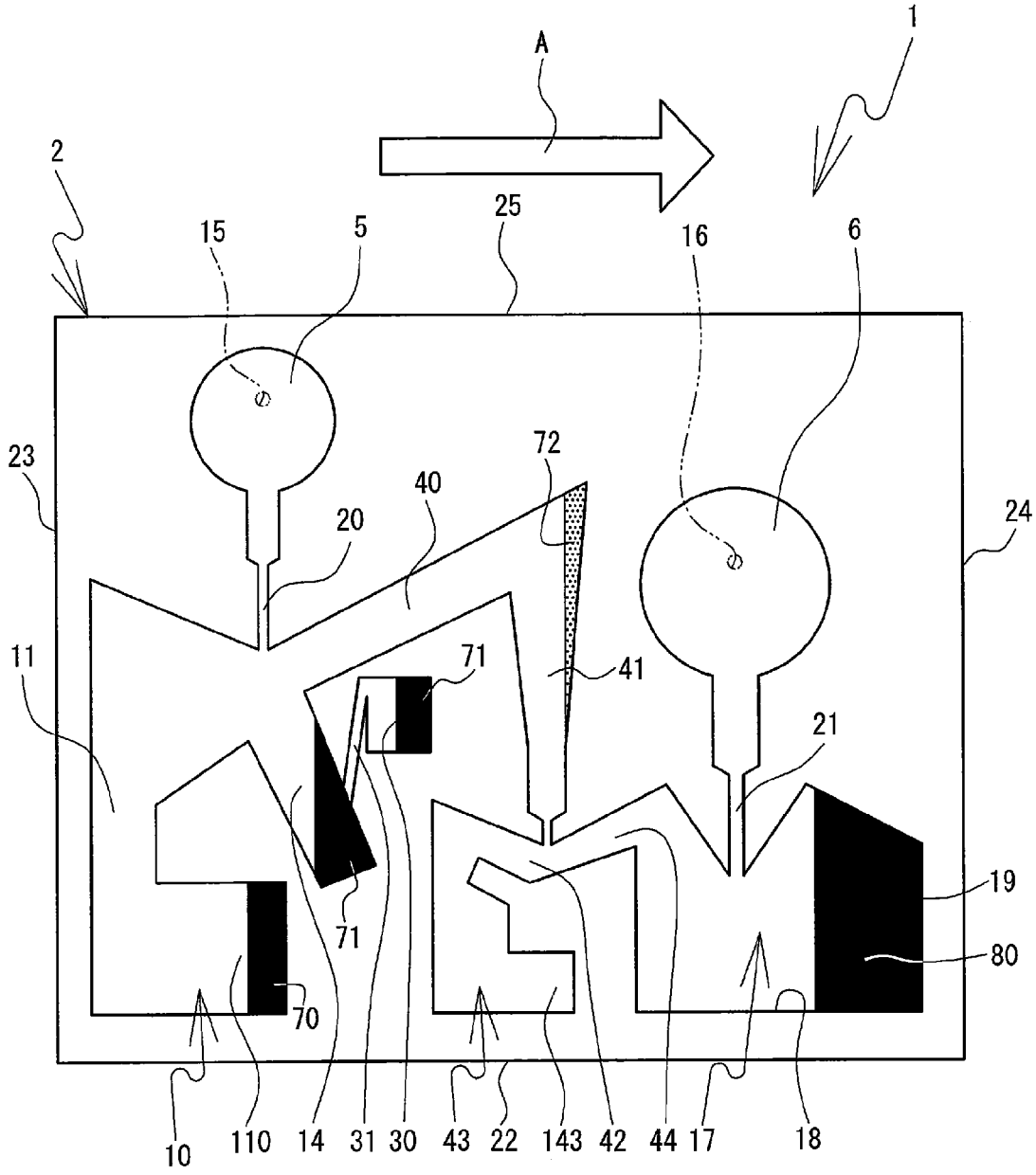
FIG. 8 is a front view of the plate member 2 showing a state in which a residual component 71 is trapped in a holding portion 30, when the test chip 1 is rotated by 90 degrees in the clockwise direction from the state shown in FIG. 6, the centrifugal force is applied thereto, and the separated component 72 is moved to the next stage.

In the state shown in FIG. 7, when the test chip 1 is revolved by the test device 100, the residual component 71 in the separation portion 14 flows into the holding portion 30 via the second flow path 31 as shown in FIG. 8. Therefore, it is possible to inhibit the residual component 71 in the separation portion 14 from flowing into the first flow path 40. A volume of the holding portion 30 is formed to be a volume that inhibits the residual component 71 from overflowing, while taking into account a volume of the residual component 71.

Figure 9:
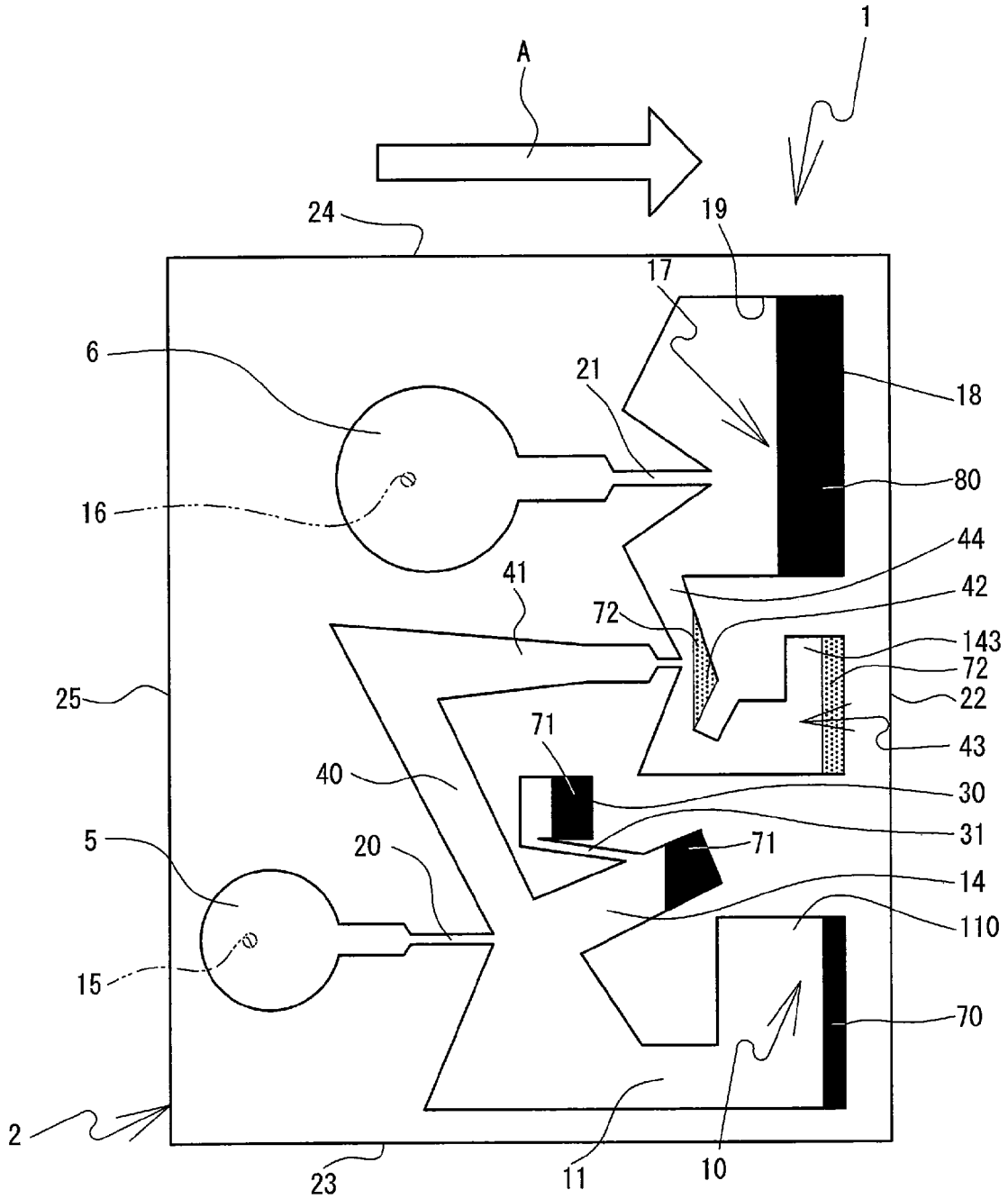
FIG. 9 is a front view of the plate member 2 in a state in which the test chip 1 is rotated by 90 degrees in the counterclockwise direction from a state shown in FIG. 8 and the centrifugal force is applied thereto.

Next, when the test chip 1 is rotated by 90 degrees in the counterclockwise direction, a state shown in FIG. 9 is obtained and the extending directions of the left end portion 23 and the right end portion 24 of the test chip 1 are positioned in parallel with the diameter direction of the turntable 103 of the test device 100 shown in FIG. 1. In the state shown in FIG. 9, when the test chip 1 is revolved by the test device 100, the centrifugal force is applied in the direction of the arrow A shown in FIG. 9. Then, the separated component 72 accumulated in the fourth flow path 41 flows into the measuring portion 42, and a predetermined amount of the separated component 72 is measured off, the predetermined amount being equivalent to a volume of a recessed portion of a triangular shape in a front view. The overflow excess separated component 72 flows into the second excess portion 43. The test reagent 80 in the receiving portion 17 is accumulated on the side of the bottom portion 18 of the receiving portion 17. The residual component 71 accumulated in the holding portion 30 is held therein and does not flow backward from inside the holding portion 30.

Figure 10:
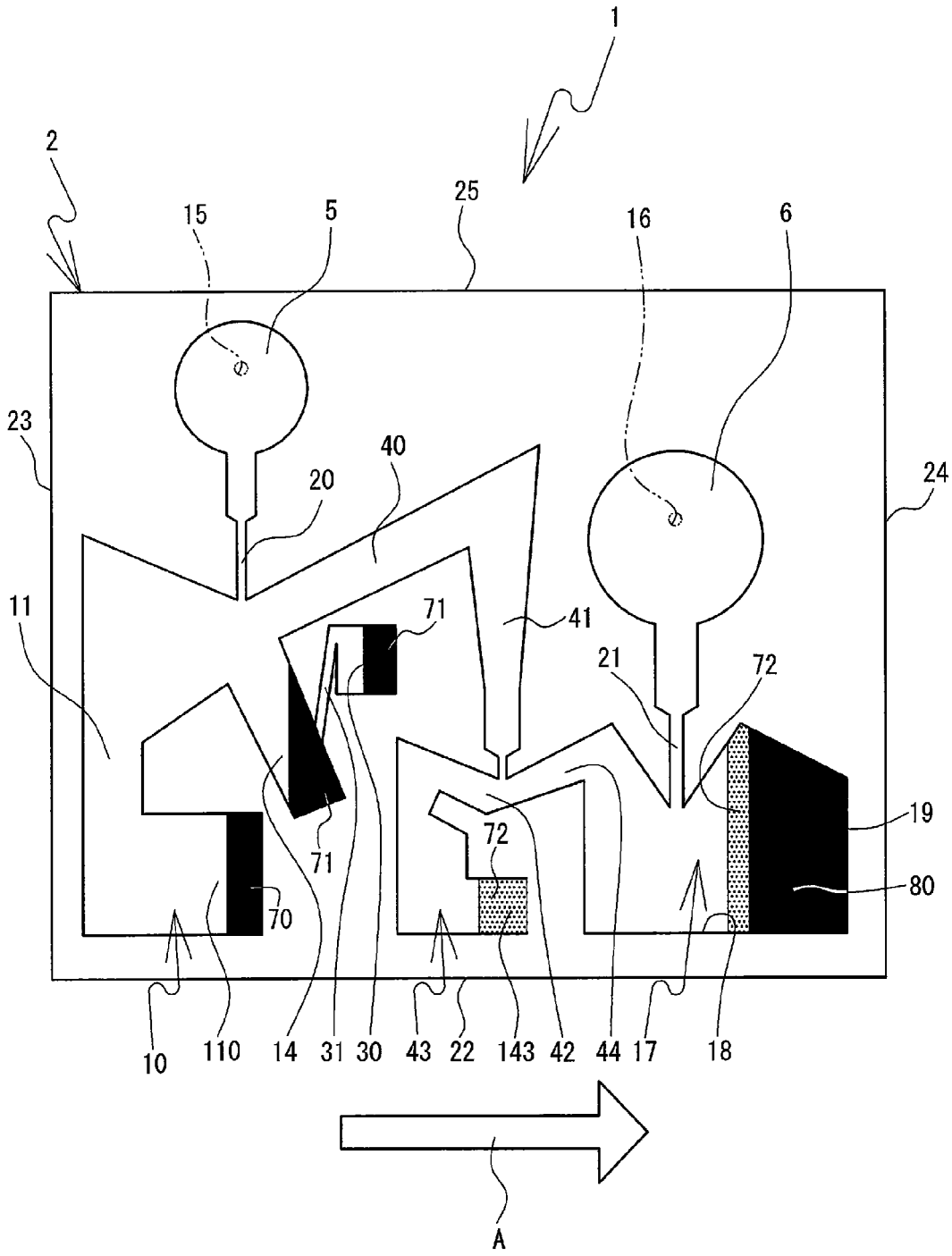
FIG. 10 is a front view of the plate member 2 in a state in which the test chip 1 is rotated by 90 degrees in the clockwise direction from a state shown in FIG. 9 and the centrifugal force is applied thereto.

Next, when the test chip 1 is rotated by 90 degrees in the counterclockwise direction, a state shown in FIG. 10 is obtained and the extending directions of the lower end portion 22 and the upper end portion 25 of the test chip 1 are positioned in parallel with the diameter direction of the turntable 103 of the test device 100. In the state shown in FIG. 10, when the test chip 1 is revolved by the test device 100, the centrifugal force is applied in the direction of the arrow A shown in FIG. 10. Then, due to the component force of the centrifugal force, the separated component 72 measured in the measuring portion 42 climbs up an inclined wall portion of the measuring portion 42 and flows into the receiving portion 17 from the fifth flow path 44. The excess separated component 72 inside the second excess portion 43 is accumulated in the rear portion 143 of the second excess portion 43 and does not flow backward. The residual component 71 accumulated in the holding portion 30 is held therein and does not flow backward from inside the holding portion 30.

Figure 11:
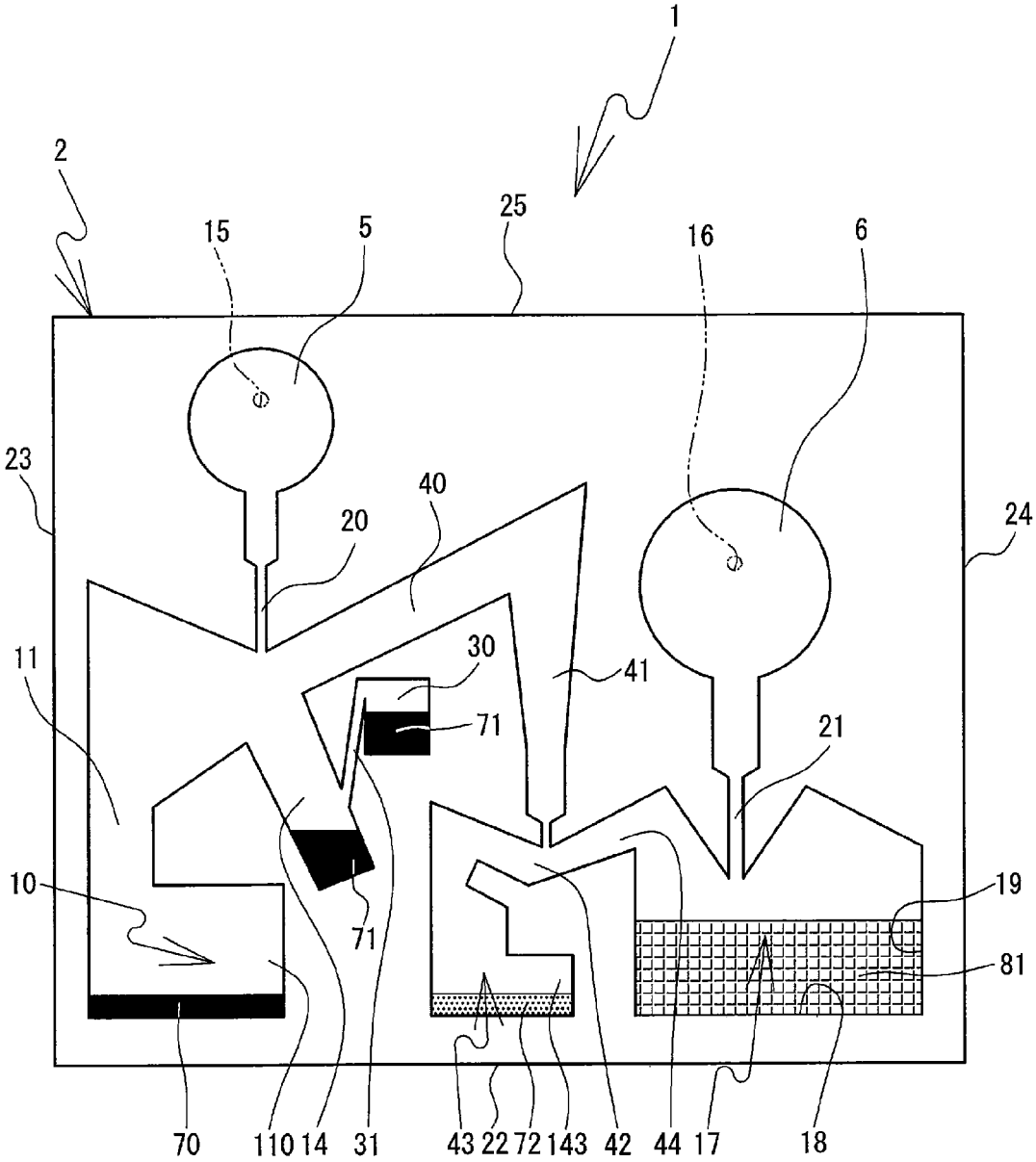
FIG. 11 is a front view of the plate member 2 in a state in which the centrifugal force is stopped being applied to the test chip 1, the test chip 1 being in a state shown in FIG. 10.

Next, when the turntable 103 of the test device 100 is stopped, as shown in FIG. 11, the test reagent 80 that has flowed into the receiving portion 17 and the separated component 72 that has flowed into the receiving portion 17 from the measuring portion 42 are mixed and then become a mixed liquid 81. In a state shown in FIG. 11, the excess separated component 72 is accumulated on a bottom portion of the second excess portion 43, and the test object liquid 70 is accumulated on a bottom portion of the first excess portion 10. On a bottom portion of the holding portion 30, the residual component 71 is accumulated, and on a bottom portion of the separation portion 14, the residual component 71 is accumulated. After that, a measurement is performed by a method such as an optical test in which the mixed liquid 81 mixed in the receiving portion 17 is examined by shedding light on the mixed liquid 81. Note that in the first embodiment, as the holding portion 30 and the second flow path 31 are provided, it is possible to inhibit the residual component 71 from flowing into the side of the first flow path 40, which is the next stage, and being mixed with the test reagent 80 in the receiving portion 17.

Second Embodiment

Figure 12:
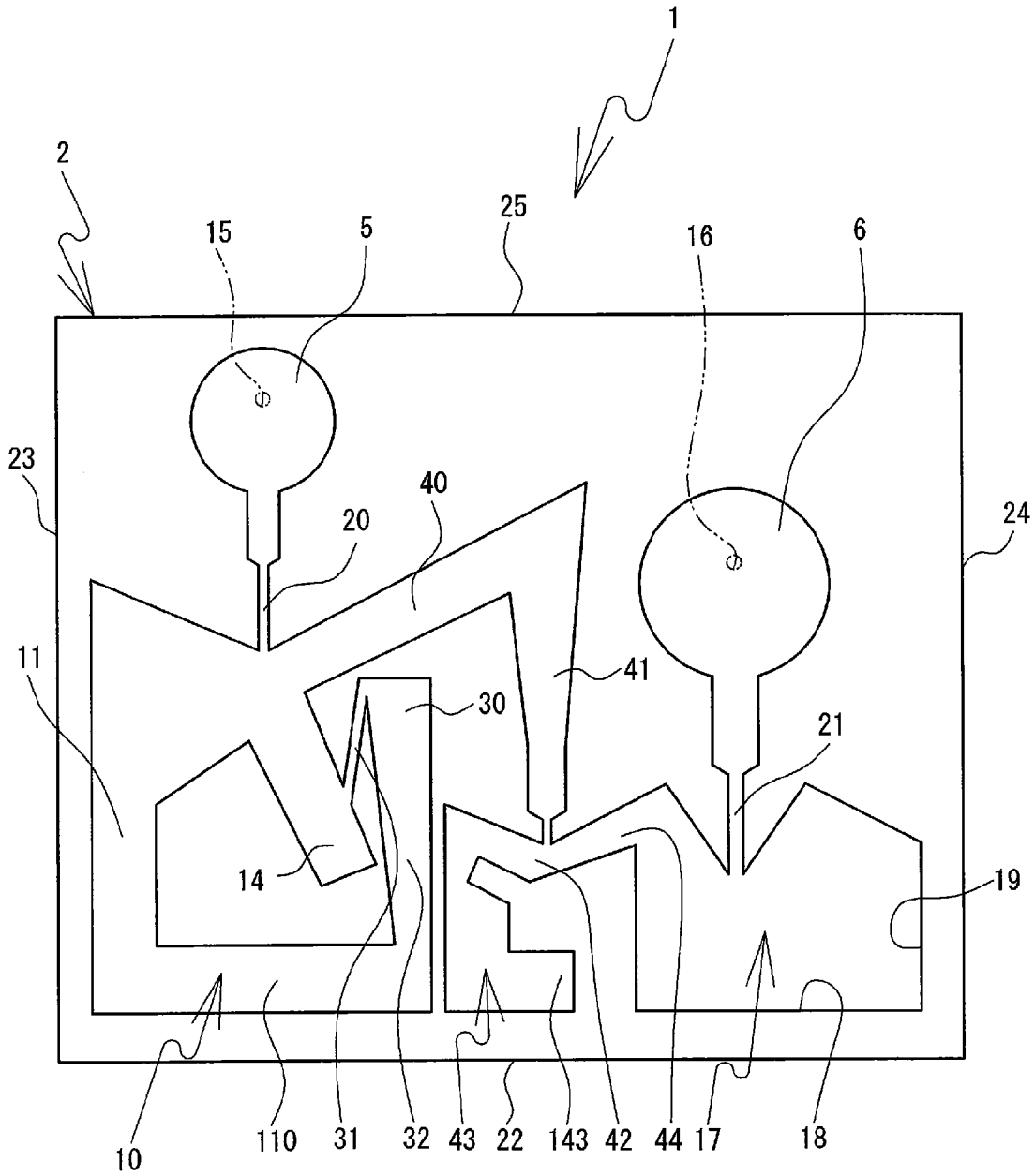
FIG. 12 is a front view of the plate member 2 of the test chip 1 according to a second embodiment.

In the test chip 1 according to a second embodiment shown in FIG. 12, a different point from the first embodiment is that the holding portion 30 that traps the residual component is connected to a connection portion 32 by the first excess portion 10. Otherwise, a structure thereof is the same structure as the test chip 1 according to the first embodiment. In the second embodiment, it becomes easier to secure space as there is no need to make the holding portion 30 large. Further, as it is possible to integrally process the first excess portion 10 and the holding portion 30, the processing becomes easier. Further, a sufficient capacity of the holding portion 30 that traps the residual component can be secured.

Third Embodiment

Figure 13:
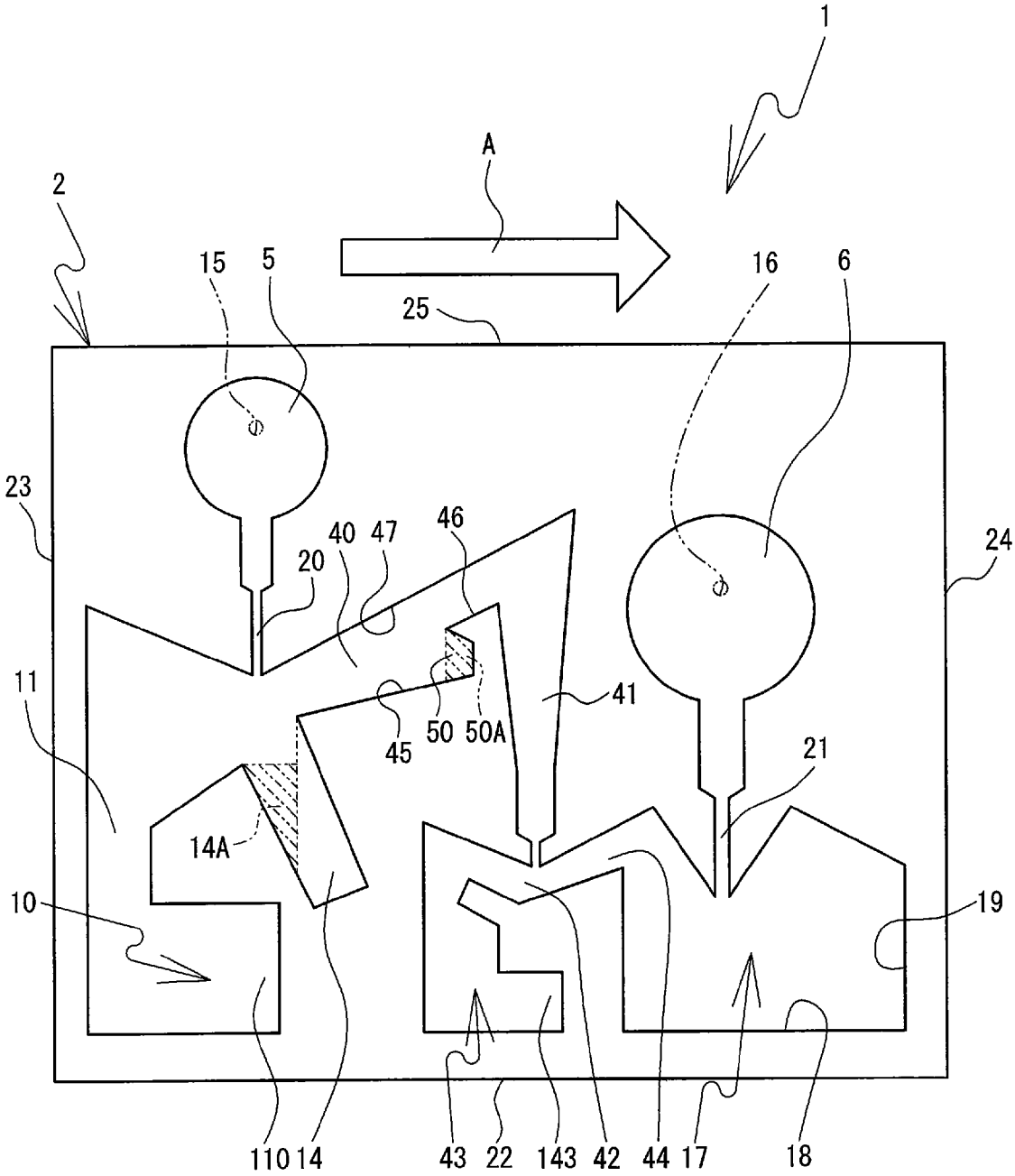
FIG. 13 is a front view of the plate member 2 of the test chip 1 according to a third embodiment.

In the test chip 1 according to a third embodiment shown in FIG. 13, a different point from the first embodiment is that the holding portion 30 that traps the residual component is not provided in the separation portion 14. Instead of the holding portion 30, a holding portion 50 is provided on the downstream side of the first flow path 40. The holding portion 50 traps the residual component that has flowed out from the separation portion 14 and is a recessed portion having a predetermined depth. Otherwise, a structure thereof is the same structure as the test chip 1 according to the first embodiment. In the test chip 1 according to the third embodiment, the holding portion 50 has an opening on the extending direction of the first flow path 40, while making a first inclination angle is smaller than a second inclination angle and a third inclination angle. The first inclination angle is an angle of a bottom wall 45 of the first flow path 40 with respect to the direction of the centrifugal force, which is the direction of the arrow A. The second inclination angle is an angle of a bottom wall 46 of the first flow path 40 with respect to the direction of the centrifugal force. The third inclination angle is an angle of an upper wall 47 of the first flow path 40 with respect to the direction of the centrifugal force. Therefore, even when the residual component flows out from the separation portion 14 to the first flow path 40, the residual component can be reliably trapped in the holding portion 50.

Further, as shown in FIG. 13, the test chip 1 is formed such that a volume 50A of the holding portion 50 becomes smaller than a volume 14A of the separated component separated and taken out in the separation portion 14. As a result, it is possible to inhibit the entire separated component separated and taken out in the separation portion 14 from being trapped in the holding portion 50.

Fourth Embodiment

Figure 14:
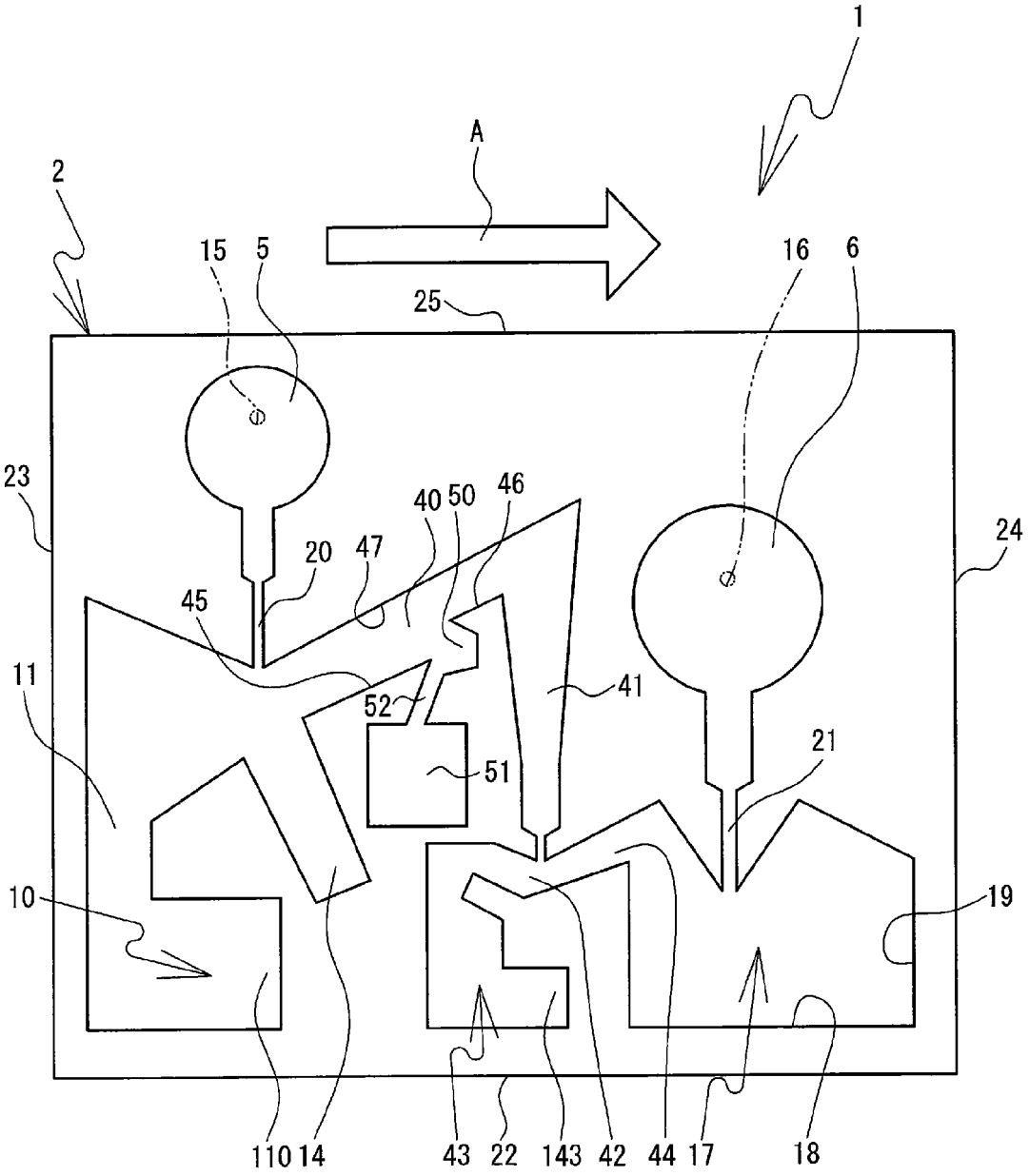
FIG. 14 is a front view of the plate member 2 of the test chip 1 according to a fourth embodiment.

In the test chip 1 according to a fourth embodiment shown in FIG. 14, a different point from the first embodiment is that the holding portion 30 that traps the residual component is not provided in the separation portion 14. Instead of the holding portion 30, the holding portion 50 and a second holding portion 51 are connected by a third flow path 52. The holding portion 50 is provided on the downstream side of the first flow path 40 and traps the residual component flowed out from the separation portion 14. The second holding portion 51 is a recessed portion of a rectangular shape in a front view having a predetermined depth. The third flow path 52 is a recessed portion having a predetermined depth, a predetermined width and a predetermined length. With this structure, the residual component or the like trapped in the holding portion 50 can flow into the second holding portion 51 via the third flow path 52. Further, as the third flow path 52 is connected to an upper part of the second holding portion 51 as shown in FIG. 14, even when the centrifugal force indicated by the arrow A is applied, the residual component does not flow backward from the second holding portion 51 to the holding portion 50 via the third flow path 52.

Fifth Embodiment

Figure 15:
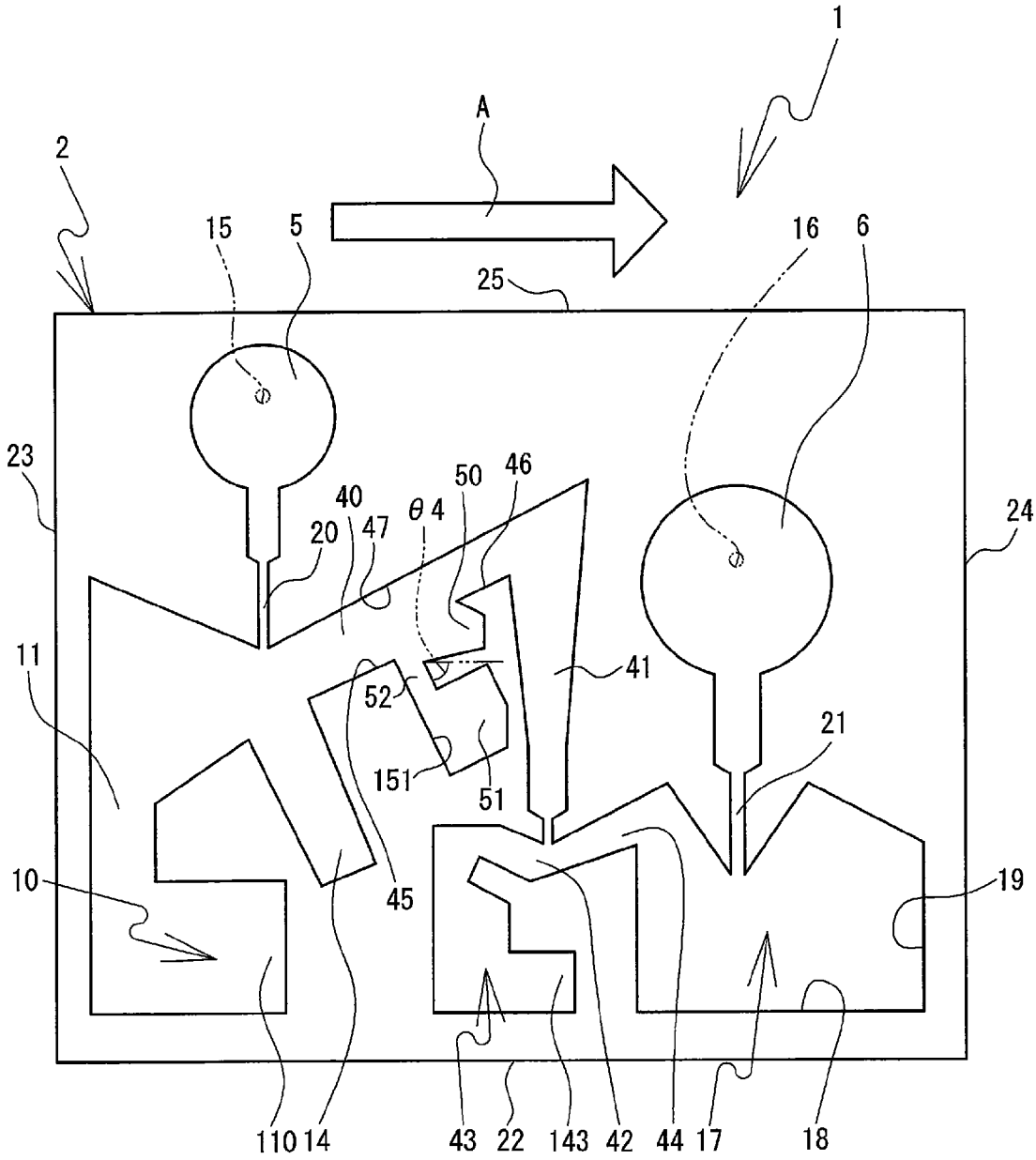
FIG. 15 is a front view of the plate member 2 of the test chip 1 according to a fifth embodiment.

In the test chip 1 according to a fifth embodiment shown in FIG. 15, a connection angle of the third flow path 52 with respect to the holding portion 50 and a connection position of the third flow path 52 to the second holding portion 51 are different from those of the fourth embodiment. More specifically, an angle θ4 formed by an extending direction of the third flow path 52 and the direction of the centrifugal force, which is the direction of the arrow A, is less than or equal to 90 degrees. Further, the third flow path 52 is connected in an upper portion of the second holding portion 51 to an end portion on the opposite side to the direction of the centrifugal force, namely, on a side of a wall portion 151. Therefore, even when the centrifugal force indicated by the arrow A is applied, the residual component does not flow backward from the second holding portion 51 to the holding portion 50 via the third flow path 52.

Sixth Embodiment

Figure 16:
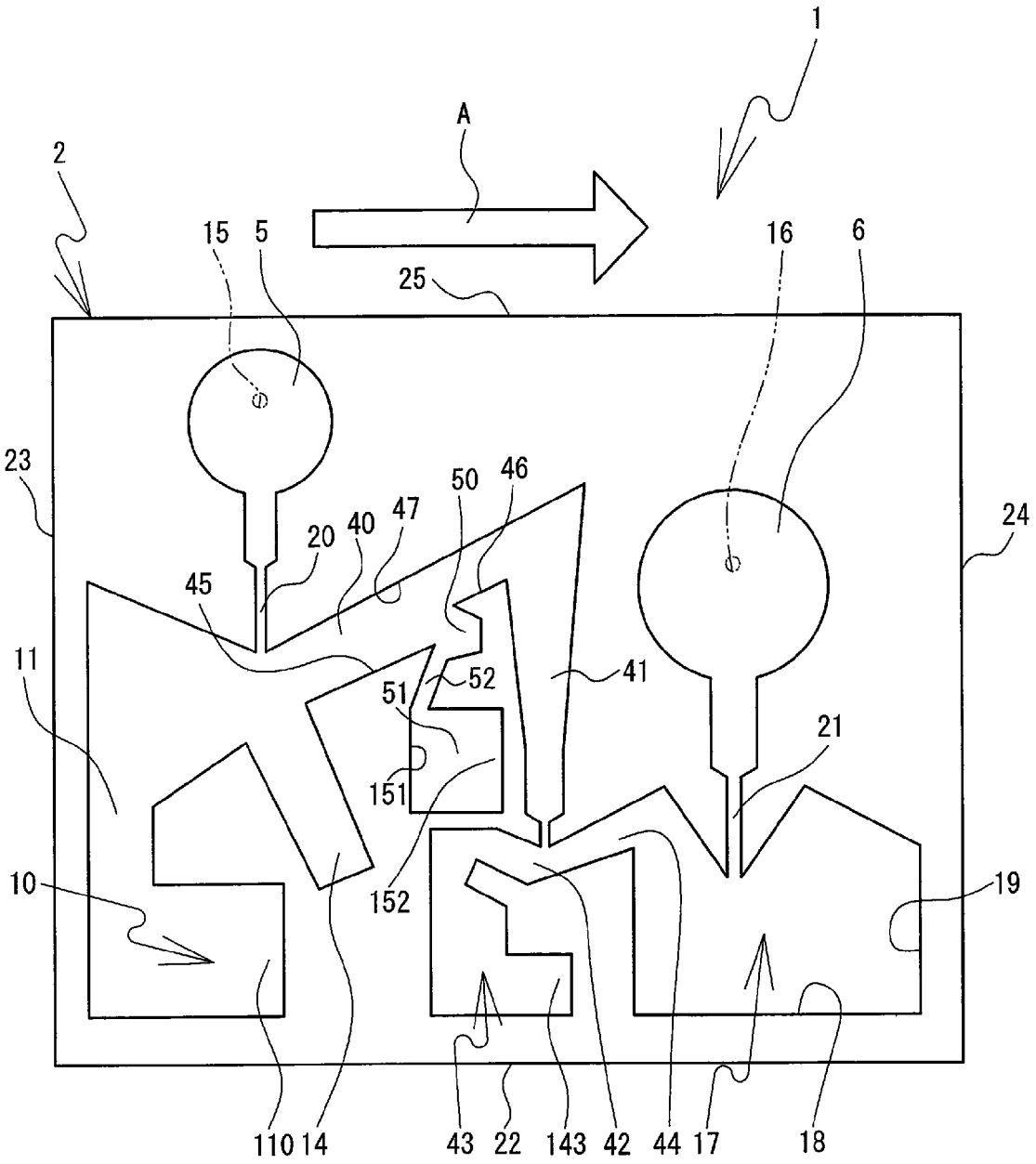
FIG. 16 is a front view of the plate member 2 of the test chip 1 according to a sixth embodiment.

In the test chip 1 according to a sixth embodiment shown in FIG. 16, a connection position of the third flow path 52 with respect to the holding portion 50 and an extending direction of the second holding portion 51 are different from those of the fourth embodiment. More specifically, the third flow path 52 is connected in the upper portion of the second holding portion 51 to the end portion on the opposite side to the direction of the centrifugal force, which is the direction of the arrow A, namely, on the side of the wall portion 151. Further, a rear portion 152 of the second holding portion 51 extends from a position at which the third flow path 52 and the second holding portion 51 make contact with each other toward the direction of the centrifugal force obtained at a time of a state in which the separated component is moved from the separation portion 14 to the next stage by the centrifugal force. Therefore, even when the centrifugal force indicated by the arrow A is applied, the residual component does not flow backward from the second holding portion 51 to the holding portion 50 via the third flow path 52.

Seventh Embodiment

Figure 17:
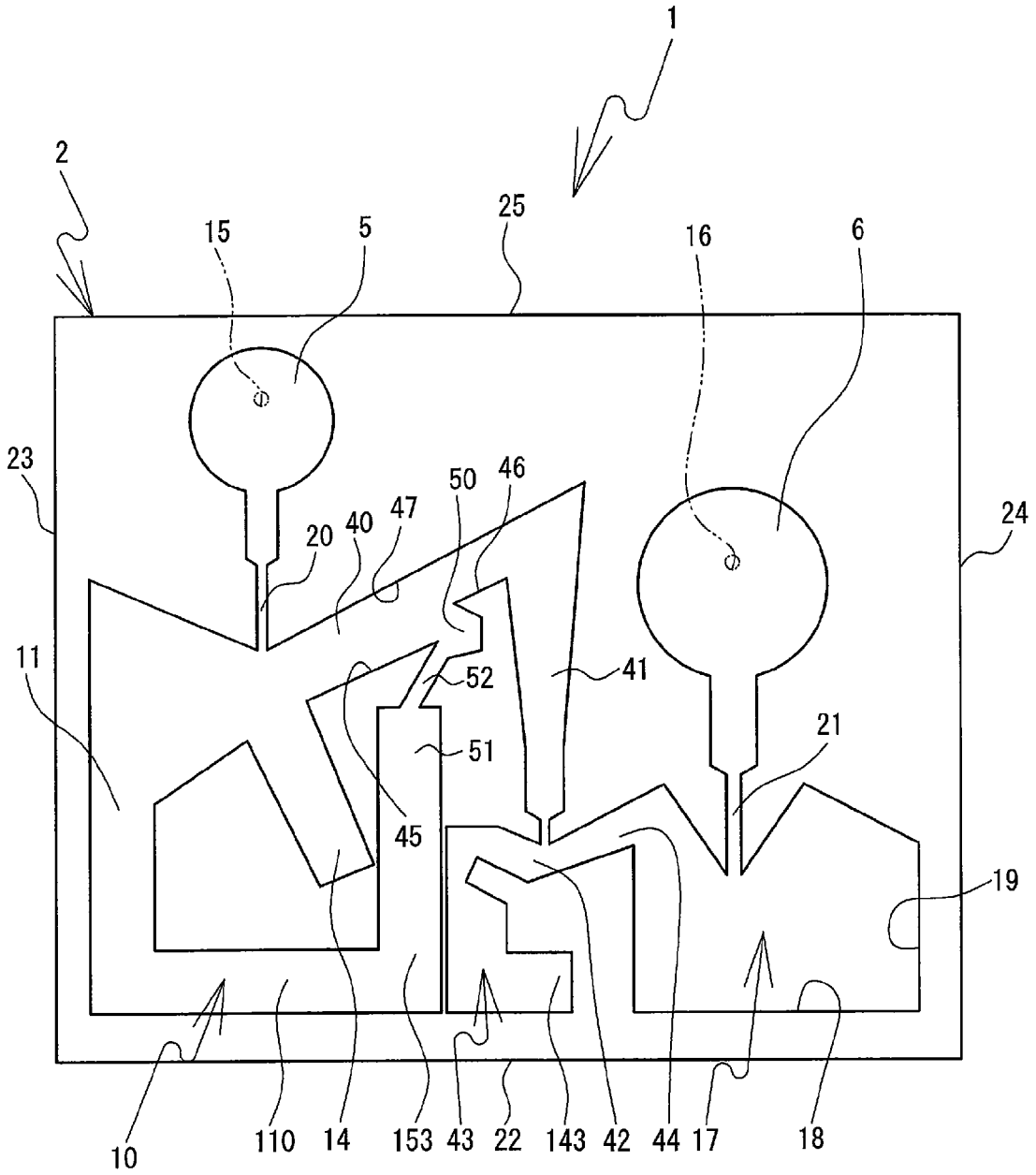
FIG. 17 is a front view of the plate member 2 of the test chip 1 according to a seventh embodiment.

In the test chip 1 according to a seventh embodiment shown in FIG. 17, a different point from the fourth embodiment is that the second holding portion 51 that accumulates the residual component is connected to the first excess portion 10 by a connection portion 153. Otherwise, a structure thereof is the same structure as the test chip 1 according to the fourth embodiment. In the seventh embodiment, it becomes easier to secure space as there is no need to make the second holding portion 51 large. Further, as it is possible to integrally process the first excess portion 10 and the second holding portion 51, the processing becomes easier. Further, a sufficient capacity of the second holding portion 51 that traps the residual component can be secured.

Note that the present disclosure is not limited to the above-described embodiments, but various modifications may be made thereto. For example, a material of the test chip 1 is not limited to a particular material, but various organic materials can be used, including polyethylene terephthalate (PET), polybutylene terephthalate (PBT), polymethylmethacrylate (PMMA), polycarbonate (PC), polystyrene (PS), polypropylene (PP), polyethylene (PE), polyethylene naphthalate (PEN), polyarylate resin (PAR), acrylonitrile butadiene styrene resin (ABS), polyvinyl chloride resin (PVC), polymethylpentene resin (PMP), polybutadiene resin (PBD), biodegradable polymer (BP), cyclo-olefin polymer (COP) and polydimethylsiloxane (PDMS). Further, inorganic materials, such as silicon, glass and quartz, may also be used.

Further, although two liquid injection inlets are provided in the test chip 1, one, three, four or any number of the injection inlets may be provided as desired. Further, the test object liquid is not limited to blood, but various types of liquid can be measured and centrifugally separated for testing, as long as the liquid is a mixed liquid with components having different specific gravities from each other.

Further, the test chip 1 may have a structure in which the holding portion 30 is provided in the separation portion 14 and the holding portion 50 is provided in the first flow path 40. Further, it may have a structure in which the holding portion 30 is provided in the separation portion 14, the holding portion 50 is provided in the first flow path 40, and the second holding portion 51 is connected to the holding portion 50 by the third flow path 52.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A test chip comprising:

a substrate including a surface on which a flow path is formed;

a lid member configured to cover the surface of the substrate;

a separation portion formed on the substrate and configured to separate components of a test object liquid into a separated component and a residual component by centrifugal force, the residual component having a larger specific gravity than a specific gravity of the separated component;

a first flow path formed on the substrate and connecting the separation portion and a receiving portion, the first flow path being configured to guide the separated component from the separation portion to the receiving portion;

a first holding portion formed on the substrate and connected to at least one of the separation portion and the first flow path, the first holding portion being configured to hold at least part of the residual component, the part of residual component overflowing from the separation portion in a case where the separated component separated in the separation portion is moved from the separation portion to the receiving portion via the first flow path; and a second flow path formed on the substrate and connecting a side wall, of the separation portion, on a side of the first flow path and the first holding portion, the second flow path being configured to guide the residual component from the separation portion to the first holding portion, the side wall extending in a direction between a first centrifugal force direction and a second centrifugal force direction, the first centrifugal force direction being a direction of the centrifugal force to be applied to the test chip when the test object liquid is introduced from a liquid accumulation portion to the separation portion and when, in the separation portion, the components of the test object liquid are separated into the separated component and the residual component, the liquid accumulation portion being formed on the substrate and positioned on an upstream side in the first centrifugal force direction with respect to the separation portion and being configured to accumulate the test object liquid, the second centrifugal force direction being a direction of the centrifugal force to be applied to the test chip when the separated component is moved from the separation portion to the receiving portion.

2. The test chip according to claim 1, wherein, an angle formed by an extending direction of the second flow path and an extension line is greater than or equal to 90 degrees, the extension line extending in the first centrifugal force direction from a connection portion of the side wall and the second flow path.

3. The test chip according to claim 1, wherein a connection portion between the separation portion and the second flow path is positioned on an upstream side in the first centrifugal force direction with respect to a boundary surface between the separated component and the residual component, the boundary surface being obtained when, in the separation portion, the components of the test object liquid are separated into the separated component and the residual component by the centrifugal force in the first centrifugal force direction.

4. The test chip according to claim 1, wherein the side wall being positioned on a side of the separation portion where the separated component is accumulated after, in the separation portion, the components of the test object liquid are separated into the separated component and the residual component.

5. The test chip according to claim 1, wherein a first angle is larger than a second angle, the first angle being formed by the second centrifugal force direction and an extending direction of the second flow path and being formed on a side of the receiving portion, the second angle being formed by the second centrifugal force direction and an extending direction of the first flow path and being formed on the side of the receiving portion.

6. The test chip according to claim 1, further comprising:

an excess portion formed on the substrate and connected to the first holding portion, the excess portion being configured to accumulate an overflowed test object liquid from the separation portion when the test object liquid is introduced from a liquid accumulation portion to the separation portion.

7. The test chip according to claim 1, wherein the first holding portion is provided to the first flow path.

8. The test chip according to claim 7, further comprising:

a third flow path connecting the first holding portion and a second holding portion, the second holding portion being positioned on a downstream side in the first centrifugal force direction with respect to the first holding portion and being configured to accumulate the residual component held in the first holding portion.

9. The test chip according to claim 7, wherein a volume of the first holding portion is smaller than a volume of the separated component separated in the separation portion.

10. The test chip according to claim 7, wherein the first holding portion has an opening on an extending direction of the first flow path.

11. The test chip according to claim 8, wherein an angle formed by the second centrifugal force direction and an extending direction of the third flow path is less than or equal to 90 degrees, the extending direction being a direction of the third flow path from the first holding portion to the second holding portion.

12. The test chip according to claim 8, wherein the second holding portion extends to the second centrifugal force direction with respect to a position at which the third flow path and the second holding portion are connected to each other.

13. The test chip according to claim 8, further comprising:

an excess portion formed on the substrate and connected to the second holding portion, the excess portion being configured to accumulate an overflowed test object liquid that overflows from the separation portion when the test object liquid is introduced from a liquid accumulation portion to the separation portion.

* * * * *